US012320530B2

(12) United States Patent
Paller

(10) Patent No.: US 12,320,530 B2
(45) Date of Patent: Jun. 3, 2025

(54) SYSTEMS AND METHODS FOR OPERATING AN IGNITER OF AN OVEN APPLIANCE

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 507 days.

(21) Appl. No.: 17/826,346

(22) Filed: May 27, 2022

(65) Prior Publication Data

US 2023/0383952 A1 Nov. 30, 2023

(51) Int. Cl.

| | |
|---|---|
| ***F24C 3/12*** | (2006.01) |
| ***F23Q 7/12*** | (2006.01) |
| ***F23Q 7/22*** | (2006.01) |
| ***F24C 3/08*** | (2006.01) |

(52) U.S. Cl.

CPC ..... *F24C 3/128* (2013.01); *F23Q 7/12* (2013.01); *F23Q 7/22* (2013.01); *F24C 3/087* (2013.01)

(58) Field of Classification Search

CPC ..... F23Q 7/12; F23Q 7/22

See application file for complete search history.

(56) References Cited

U.S. PATENT DOCUMENTS

| | | | | |
|---|---|---|---|---|
| 3,980,420 | A | 9/1976 | Baysinger et al. | |
| 9,068,752 | B2 | 6/2015 | Shaffer et al. | |
| 2004/0209209 | A1* | 10/2004 | Chodacki | F23N 1/002 431/66 |
| 2013/0087215 | A1* | 4/2013 | Park | F23N 5/245 137/79 |
| 2019/0301741 | A1 | 10/2019 | Shindle et al. | |
| 2020/0182460 | A1* | 6/2020 | Bentley | F23D 14/725 |

* cited by examiner

*Primary Examiner* — Ko-Wei Lin

(74) *Attorney, Agent, or Firm* — Dority & Manning, P.A.

(57) ABSTRACT

A gas oven appliance includes a cooking chamber, a gas burner positioned in the cooking chamber, an igniter positioned at the gas burner, and a gas valve coupled to the igniter. The gas valve includes a bimetallic strip. A controller is configured to operate the igniter. The controller cycles the ignitor between on and off at an interval of time to at least keep the bimetallic strip above a temperature threshold.

18 Claims, 3 Drawing Sheets

SYSTEMS AND METHODS FOR OPERATING AN IGNITER OF AN OVEN APPLIANCE

FIELD OF THE INVENTION

The present subject matter relates generally to systems and methods for operating igniters of oven appliances.

BACKGROUND OF THE INVENTION

Oven appliances generally define one or more enclosures supporting one or more heating elements. For instance, oven appliances can include a cabinet defining an insulated cooking chamber therein for receipt of food items for cooking. Heating elements, such as a bake heating element or broil heating element, may be positioned within the cooking chamber to provide heat to food items located therein. The bake heating element is positioned at a bottom of the cooking chamber. The broil heating element positioned at a top of the cooking chamber. One or more electronic components may be housed within the cabinet outside of the cooking chamber.

In general, it can be desirable to manage heat or temperatures at outer surface of the cabinet or enclosure. Typically, for gas oven appliances, an igniter in the gas burner draws electricity to ignite the gaseous fuel flowing from the gas burner. For the ignition of the gas to occur, the ignitor can reach high temperatures, which can heat nearby components of the gas oven appliance. Such unwanted heating of the components adjacent to the ignitor can affect performance or can cause uneven temperatures in the cooking chamber.

BRIEF DESCRIPTION OF THE INVENTION

Aspects and advantages of the invention will be set forth in part in the following description, or may be apparent from the description, or may be learned through practice of the invention.

In one example embodiment, a gas oven appliance includes a cooking chamber, a gas burner positioned in the cooking chamber, an igniter positioned at the gas burner, and a gas valve coupled to the igniter. The gas valve includes a bimetallic strip. A controller is configured to operate the igniter. The controller cycles the ignitor between activated and deactivated at an interval of time to at least keep the bimetallic strip above a temperature threshold.

In another example embodiment, a gas oven appliance includes a cooking chamber, a gas burner positioned in the cooking chamber, an igniter positioned at the gas burner, and a gas valve coupled to the igniter. The gas valve includes a bimetallic strip. A controller is configured to operate the igniter and the gas valve. The controller, after a delay, cycles the ignitor between activated and deactivated at an interval of time to at least keep the igniter below a temperature threshold.

In another example embodiment, a method of operating an oven appliance during a cooking cycle includes receiving, at a controller, a temperature signal indicative of a temperature of the oven appliance. Comparing, by the controller, the temperature of the oven appliance to a set temperature. Adjusting, at the controller, the operation of an igniter and a gas valve. Monitoring, at the controller, a delay temperature compared to the temperature of the oven appliance. Then cycling, at the controller, the operation of the ignitor and the gas valve at an interval of time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
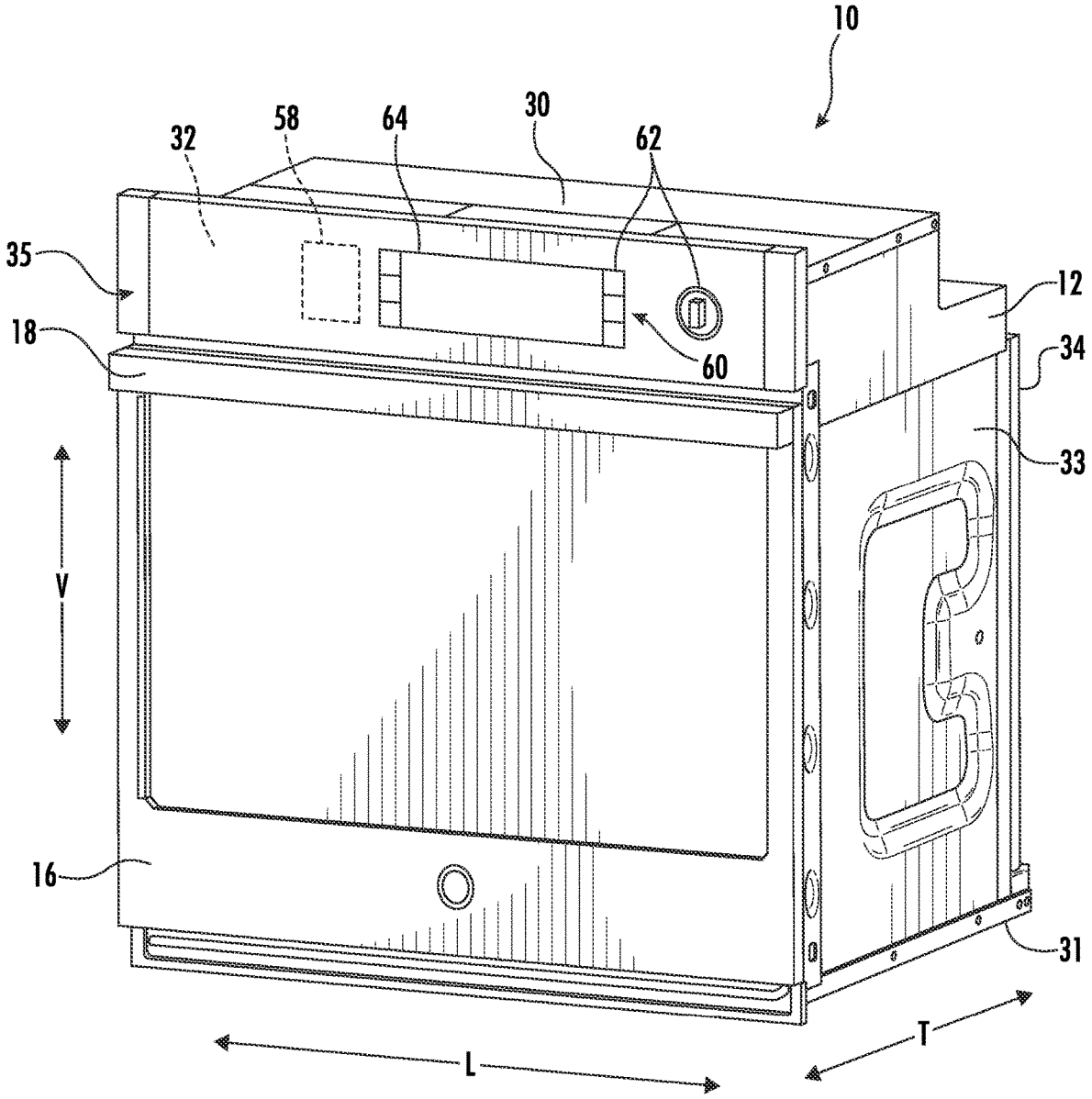
FIG. 1 provides a perspective view of an oven appliance according to example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present disclosure covers such modifications and variations as come within the scope of the appended claims and their equivalents.

As used herein the terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value. For example, the approximating language may refer to being within a 10 percent margin (i.e., including values within ten percent greater or less than the stated value).

The word "example" is used herein to mean "serving as an example, instance, or illustration." In addition, references to "an embodiment" or "one embodiment" does not necessarily refer to the same embodiment, although it may. Any implementation described herein as "example" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
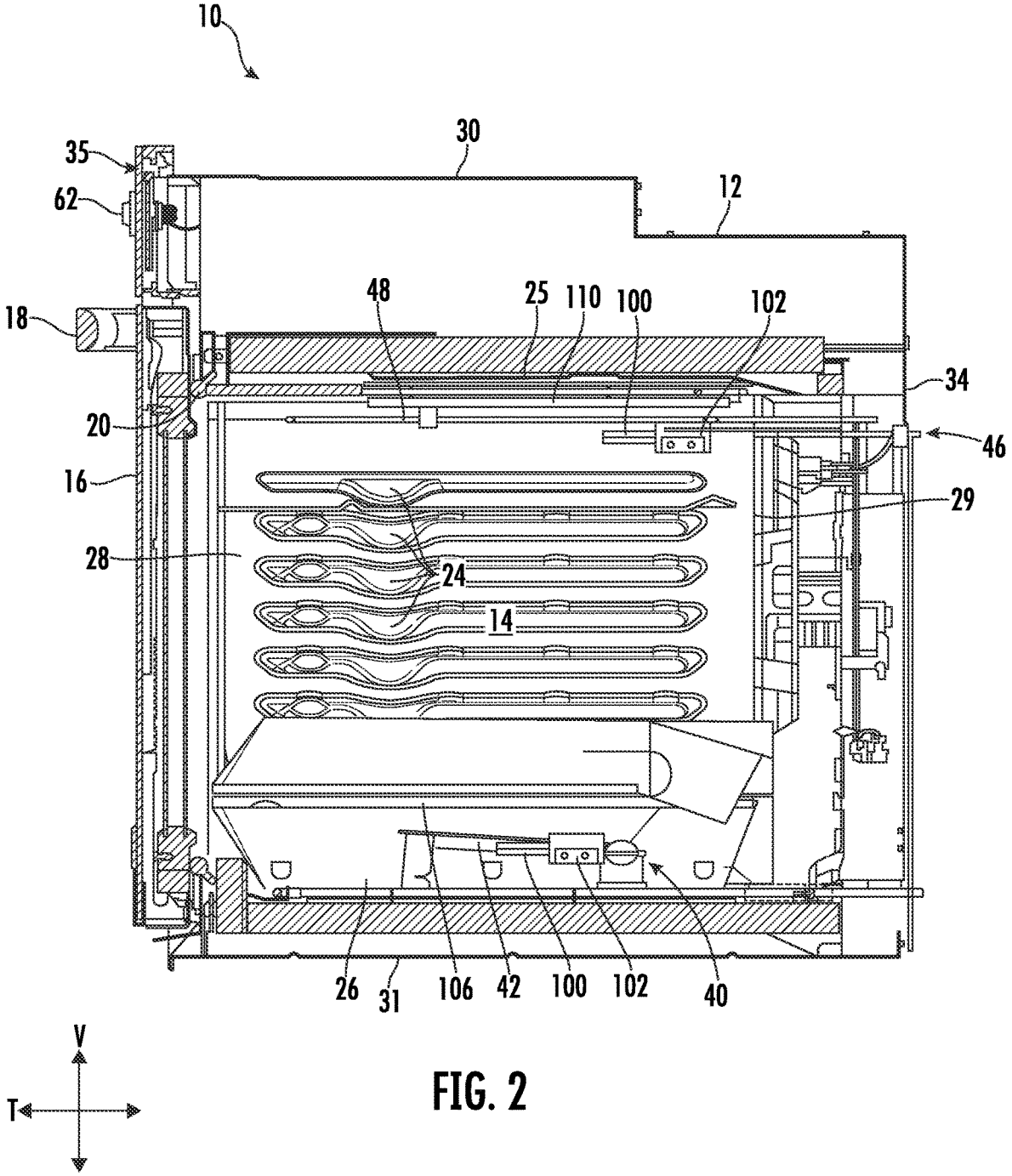
FIG. 2 provides a section view of the example oven appliance of FIG. 1, taken along the lines 2-2.

Referring now to the figures, FIGS. 1 and 2 depict an example oven appliance 10 that may be configured in accordance with aspects of the present disclosure. FIG. 1 provides a perspective view of oven appliance 10 according to an example embodiment of the present disclosure. FIG. 2 provides a cross-sectional view of oven appliance 10 taken along the 2-2 line of FIG. 1. For the embodiment of FIGS. 1 and 2, oven appliance 10 defines a vertical direction V, a lateral direction L and a transverse direction T. The vertical, lateral and transverse directions are mutually perpendicular and form an orthogonal direction system. As will be understood by those skilled in the art, oven appliance 10 is provided by way of example only, and the present subject matter may be used in any suitable oven appliance. Thus, the present subject matter may be used with other oven appliances having different configurations.

Oven appliance 10 includes a cabinet 12 with an insulated cooking chamber 14 disposed within cabinet 12. Insulated cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access insulated cooking chamber 14. For example, a user can pull on handle 18 to open or close door 16 and access insulated cooking chamber 14.

Various chamber walls define insulated cooking chamber 14. For example, insulated cooking chamber 14 includes a top wall 25 and a bottom wall 26 which are spaced apart along the vertical direction V. A pair of sidewalls 28 extend between the top wall 25 and bottom wall 26, and are spaced apart along the lateral direction L. A rear wall 29 may additionally extend between the top wall 25 and bottom wall 26 as well as between the pair of sidewalls 28, and is spaced apart from door 16 along the transverse direction T. In this manner, when door 16 is in the closed position, a cooking cavity is defined by door 16 and top wall 25, bottom wall 26, sidewalls 28, and rear wall 29, of insulated cooking chamber 14.

According to the illustrated embodiment, the chamber walls of insulated cooking chamber 14 are depicted as simple blocks of insulating material surrounding the cooking cavity. However, one skilled in the art will appreciate that the insulating material may be constructed of one or more suitable materials and may take any suitable shape. For example, the insulating material may be encased in one or more rigid structural members, such as sheet metal panels, which provide structural rigidity and a mounting surface for attaching, for example, heating elements, temperature probes, rack sliding assemblies, and other mechanical or electronic components.

Cabinet 12 includes multiple outer panels that enclose insulated cooking chamber 14. For example, cabinet 12 includes a top panel 30 and a bottom panel 31 which are spaced apart along the vertical direction V. Left panel 32 and right panel 33 (as defined according to the view as shown in FIG. 1) extend between the top panel 30 and bottom panel 31, and are spaced apart along the lateral direction L. A rear panel 34 may additionally extend between the top panel 30 and bottom panel 31 as well as between the left panel 32 and right panel 33, and is spaced apart from door 16 along the transverse direction T. When door 16 is in the closed position, it may sit flush with a front panel 35 of cabinet 12.

According to the illustrated embodiment, the panels of cabinet 12 are single ply sheet metal panels, but one skilled in the art will appreciate that one or more of the panels may include other suitably rigid panels while remaining within the scope of the present subject matter. For example, according to an example embodiment, one or more panels may be constructed from a suitably rigid and thermally resistant plastic. In addition, one or more panels may include multiple layers made from the same or different materials, and may be formed in any suitable shape.

Seen in FIG. 2 of the present embodiment, a lower heating assembly, e.g., bake heating assembly 40, is included in oven appliance 10, and may include one or more heating elements, e.g., gas burner 42. Gas burner 42 may be disposed within insulated cooking chamber 14, such as adjacent bottom wall 26. Gas burner 42 may generally be used to heat insulated cooking chamber 14 for both cooking and cleaning of oven appliance 10. Bake heating assembly 40 may include an igniter 100 and a gas valve 102. Igniter 100 may be a silicon-carbide igniter. Igniter 100 may be positioned on gas burner 42 and may be configured for igniting the gas flowing through gas burner 42 from gas valve 102 via a glow rod (not shown). Both igniter 100 and gas burner 42 may be positioned under, i.e., beneath in the vertical direction V, a bake flame spreader 106 to assist with distributing heat inside cooking chamber 14 from bake heating assembly 40. Gas valve 102 may be any of a thermo-mechanical safety valve, electro-mechanical safety valve, or thermo-electric safety valve. Gas valve 102 may include a bimetallic strip which opens a passageway for the flow of gas when heated above a threshold temperature. The threshold temperature may be dependent upon the bimetallic strips material property. Igniter 100 and gas valve 102 may be coupled in a series connection, e.g., to reduce heating of the igniter 100 and gas valve 102 during operation.

An upper heating assembly, e.g., broil heating assembly 46, is included in oven appliance 10, and may include one or more upper heating elements, e.g., gas burner 48. Gas burner 48 may be disposed within insulated cooking chamber 14, such as adjacent top wall 25. Gas burner 48 may generally be used to heat insulated cooking chamber 14 for both cooking and cleaning of oven appliance 10. Broil heating assembly 46 may include an igniter 100 and a gas valve 102. Igniter 100 may be positioned on gas burner 48 and may be configured for igniting the gas flowing through gas burner 48 from gas valve 102 via a glow rod (not shown). Both igniter 100 and gas burner 48 may be positioned above, i.e., in the vertical direction V, a broil flame spreader 110 to assist with distributing heat inside cooking chamber 14 from broil heating assembly 46. Top wall 25 may be configured to spread the flames from gas burner 48, alternatively referred to as a ceiling flame spreader.

Oven appliance 10 is further equipped with a controller 58 to regulate operation of the oven appliance 10. For example, controller 58 may regulate the operation of oven appliance 10 including heating elements 42, 48 (and heating assemblies 40, 46 generally). Controller 58 may be in communication (via for example a suitable wired or wireless connection) with the heating elements 42, 48 and other suitable components of the oven appliance 10, as discussed herein. In general, controller 58 may be operable to configure the oven appliance 10 (and various components thereof) for cooking. Such configuration may be based on a plurality of cooking factors of a selected operating cycles, sensor feedback, etc.

By way of example, controller 58 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 58 may be positioned in a variety of locations throughout oven appliance 10. In the illustrated embodiment, controller 58 may be located within a user interface panel 60 of oven appliance 10 as shown in FIG. 1. In such an embodiment, input/output ("I/O") signals may be routed between the control system and various operational components of oven appliance 10 along wiring harnesses that may be routed through cabinet 12. Typically, controller 58 is in communication with user interface panel 60 and controls 62 through which a user may select various operational features and modes and monitor progress of oven appliance 10. In one embodiment, user interface panel 60 may represent a general purpose I/O ("GPIO") device or functional block. In one embodiment, user interface panel 60 may include input components or controls 62, such as one or more of a variety of electrical, mechanical or electro-mechanical input devices including rotary dials, push buttons, and touch pads. User interface panel 60 may include a display component, such as a digital or analog display device 64 designed to provide operational feedback to a user.

User interface panel 60 may be in communication with controller 58 via one or more signal lines or shared communication busses. Controller 58 may also be communication with one or more sensors, e.g., a temperature sensor that is used to measure temperature inside insulated cooking chamber 14 and provide such measurements to controller 58. The temperature sensor may be a thermocouple, a thermistor, a resistance temperature detector, or any other device suitable for measuring the temperature within insulated cooking chamber 14. In this manner, controller 58 may selectively control heating elements 42, 48 in response to user manipulation of user interface panel 60 and temperature feedback from the temperature sensor. Controller 58 can also receive temperature measurements from the temperature sensor placed within insulated cooking chamber 14 and e.g., provide a temperature indication to the user with display 64.

It should be appreciated that the invention is not limited to any particular style, model, or configuration of oven appliance 10. The example embodiment depicted in the figures is for illustrative purposes only. For example, except as otherwise indicated, different locations may be provided for user interface panel 60, different configurations may be provided for the baking rack or ribs 24, different cooling air flow paths may be utilized, and other differences may be applied as well.

Igniter 100, of oven appliance 10, may draw electricity to heat up and ignite the gas flowing out of gas burners 42, 48. For the ignition of the gas to occur, the igniter 100 may reach temperatures exceeding five-hundred and forty degrees Celsius (540° C.) which can heat nearby components, such as top wall 25 and bottom wall 26. Such unwanted heating of the components adjacent to igniter 100 can affect the performance of oven appliance 10 or can cause uneven temperatures in cooking chamber 14.

Figure 3:
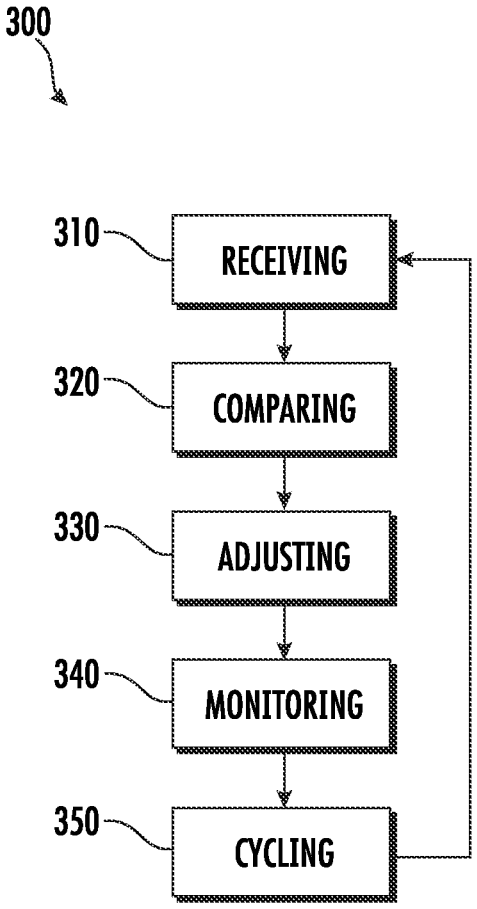
FIG. 3 provides a method of operating an oven appliance in accordance with aspects of the present disclosure.

Now referring to FIG. 3, method 300 is a method of operating an oven appliance, such as oven appliance 10 of the present disclosure, during a cooking cycle that reduces the heating of components adjacent igniter 100. While described in greater detail below in the context of oven appliance 10, it will be understood that method 300 may used in or with any other oven appliance in alternative example embodiments. As an example, controller 58 may be programmed to at least partially implement method 300.

When a cooking cycle is initiated by a user at 310, controller 58 may receive a temperature signal from a temperature sensor indicative of a temperature of oven appliance 10, such as a temperature of cooking chamber 14. At 320, the temperature signal received in 310 may be compared to a set temperature. The set temperature may be set by a user of oven appliance 10. At 330, controller 58 may adjust the operation of igniter 100 and gas valve 102. When the measured temperature from the sensor at 310 is greater than the set temperature, controller 58 may deactivate igniter 100 and gas valve 102. Conversely, when the measured temperature from the sensor at 310 is less than the set temperature, controller 58 may activate igniter 100 and gas valve 102.

In additional or alternative embodiments, at 340, controller 58 may monitor a delay with respect to the measured temperature from the sensor at 310. The delay may correspond to a period of time, or temperature, after which method 300 may begin cycling igniter 100 and gas valve 102 at 350. The monitoring at 340 may not be necessary in all example embodiments of the disclosure. At 350, controller 58 may begin to cycle the activation and deactivation of igniter 100 and gas valve 102. The cycling of igniter 100 and gas valve 102 at defined intervals of time may maintain the necessary temperature to maintain the bimetallic strip of gas valve 102 at a particular state, e.g., such that the gas valve 102 is activated without undesired heating of the components adjacent igniter 100. The defined intervals of time may include between twenty seconds and one-hundred and twenty seconds (20 s-120 s) of activated time and between two seconds and forty seconds (2-40 s) of deactivated time. Step 350 may be repeated until the cooking cycle is complete.

As may be seen from the above, a user may activate a cooking cycle for an oven appliance, such as oven appliance 10. When the cooking cycle begins, method 300 may be performed by controller 58 to heat cooking chamber 14 to the set temperature and complete the cooking cycle without overheating components adjacent igniter 100. This is advantageous as it may reduce failures of components in oven appliance 10, as well as improve cooking evenness. Adding the delay at 340 may further advantageously reduce the number of cycles performed and maintain reliability of the heating assemblies 40, 46.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas oven appliance comprising:

a cooking chamber;

a gas burner positioned in the cooking chamber;

an igniter positioned at the gas burner;

a gas valve coupled to the igniter, the gas valve comprising a bimetallic strip; and a controller configured to operate the igniter, wherein the controller is configured to cycle the igniter between an activated state and a deactivated state at an interval of time in order to maintain the bimetallic strip above a temperature threshold.

2. The oven appliance of claim 1, wherein the gas valve is coupled in series with the igniter, and the gas valve is one of a thermo-mechanical safety valve and thermo-electrical safety valve.

3. The oven appliance of claim 1, wherein the igniter comprises a silicon-carbide igniter.

4. The oven appliance of claim 1, further comprising a broil heating assembly positioned above the gas burner within the cooking chamber.

5. The oven appliance of claim 4, wherein the broil heating assembly comprises a broil gas burner, a broil igniter, and a broil flame spreader.

6. The oven appliance of claim 1, further comprising a baking heating assembly with the gas burner.

7. The oven appliance of claim 6, wherein the baking heating assembly comprises the gas burner, the igniter, and a baking flame spreader.

8. A gas oven appliance comprising:

a cooking chamber;

a gas burner positioned in the cooking chamber;

an igniter positioned at the gas burner;

a gas valve coupled to the igniter, the gas valve comprising a bimetallic strip; and a controller configured to operate the igniter and the gas valve, wherein the controller, after a delay, is configured to cycle the igniter between an activated state and a deactivated state at an interval of time in order to maintain the bimetallic strip above a temperature threshold.

9. The oven appliance of claim 8, wherein the gas valve is coupled in series with the igniter, and the gas valve is one of a thermo-mechanical safety valve and thermo-electrical safety valve.

10. The oven appliance of claim 8, wherein the igniter comprises a silicon-carbide igniter.

11. The oven appliance of claim 8, further comprising a broil heating assembly positioned above the gas burner within the cooking chamber.

12. The oven appliance of claim 11, wherein the broil heating assembly comprises a broil gas burner, a broil igniter, a broil flame spreader, and a ceiling flame spreader.

13. The oven appliance of claim 8, further comprising a baking heating assembly with the gas burner.

14. The oven appliance of claim 13, wherein the baking heating assembly comprises the gas burner, the igniter, and a baking flame spreader.

15. A method of operating an oven appliance during a cooking cycle comprising:

receiving, at a controller, a temperature signal indicative of a temperature of the oven appliance;

comparing, by the controller, the temperature of the oven appliance to a set temperature;

adjusting, at the controller, the operation of an igniter and a gas valve;

monitoring, at the controller, a delay temperature compared to the temperature of the oven appliance; and cycling, at the controller, the operation of the igniter and the gas valve at an interval of time.

16. The method of claim 15, wherein the gas valve is coupled in series with the igniter, and the gas valve is one of a thermo-mechanical safety valve and thermo-electrical safety valve.

17. The method of claim 15, wherein the igniter comprises a silicon-carbide igniter.

18. The method of claim 15, wherein the delay temperature comprises a temperature at which the igniter is deactivated while having heat to continue the cooking cycle.

* * * * *